United States Patent [19]

Krieg

[11] 4,064,771

[45] Dec. 27, 1977

[54] AUTOMATIC TORQUE CONTROLLER FOR AN IMPACT WRENCH

[76] Inventor: Adrian H. Krieg, 2627 Dunning Drive, Yorktown, N.Y. 10598

[21] Appl. No.: 776,280

[22] Filed: Mar. 10, 1977

[51] Int. Cl.[2] ..... B25B 19/00

[52] U.S. Cl. ..... 81/52.3; 81/57.44; 173/15

[58] Field of Search ..... 81/52.3, 57.44, 54; 173/15

[56] References Cited

U.S. PATENT DOCUMENTS

| | | | |
|---|---|---|---|
| 1,459,402 | 6/1923 | Johnson | 81/52.3 |
| 2,261,204 | 11/1941 | Amtsberg | 81/52.3 |
| 3,780,603 | 12/1973 | Whitaker | 81/52.3 |

*Primary Examiner*—James L. Jones, Jr.

[57] ABSTRACT

An attachment for a pneumatic impact wrench is mounted between the wrench and socket tool which fastens a nut or bolt in an assembly. The attachment controls automatically the torque applied to the nut or bolt by providing a cylindrical housing with a sliding member. The sliding member is positioned within the cylindrical housing by an extension engaging a circular groove in the socket tool, the groove being of such a depth as to be proportional to the size of the nut or both being fastened. The sliding member controls the amount of compressed air supplied to the drive motor of the impact wrench by closing off or opening the inlet and outlet for the compressed air provided in the cylindrical housing.

10 Claims, 6 Drawing Figures

AUTOMATIC TORQUE CONTROLLER FOR AN IMPACT WRENCH

BACKGROUND OF THE INVENTION

The present invention is directed to a pneumatic impact wrench used for loosening and tightening differently sized nuts and bolts. Impact wrenches are commonly used by virtually all assemblers of mechanical devices for fastening many sized nuts and bolts. In order to use the impact wrench, socket tools of varying size are used that will fit particular-sized nuts and bolts. However, since assemblers use the same pneumatic impact wrench to assemble many sized nuts and bolts, and only change the socket tools used, overtorquing or shearing of smaller nuts and bolts is very common. This is a result of choosing a pneumatic impact wrench having sufficient torque to fasten the largest nuts and bolts anticipated in an assembly. Since this torque will also be applied to the smaller nuts and bolts, overtorquing and shearing of the nuts and bolts have been all too common.

SUMMARY OF THE INVENTION

It is, therefore, the prime object of the present invention to provide an automatic torque controller for pneumatic impact wrenches where the socket toool inserted int eh impact wrench will automatically adjust the flow of compressed air to the motor of the device, thereby adjusting the torque applied to the nuts and bolts in accordance with the size thereof.

To this end, a torque contoller of cylindrical shape is mounted between the pneumatic impact wrench and the socket tool being used. The torque controller has a series of slides that move back and forth in a direction parallel to the longitudinal axis of the socket tool. The slides are biased toward the socket tool by compressed air fed into an inlet opening of the controller, the slides being biased a certain distance into a circular groove of the socket tool itself. The circular groove of the socket tool is of such depth as to allow for the slides to form a passage for the compressed air, which is fed via an outlet in the controller to the motor driving the main drive shaft of the wrench, that will be proportional to the amount of torque required to fasten the nut or bolt. For nuts or bolts of larger diameter needing the largest torque, the socket tool is provided with a circular groove of maximum depth, thereby allowing the slides to form an air passage of maximum opening and allow the motor to drive the socket tool with the maximum torque.

BRIEF DESCRIPTION OF THE DRAWINGS

The invention will be more readily understood in the following detailed description when taken in conjunction with the accompanying drawings, wherein.

DETAILED DESCRIPTION OF THE INVENTION

Figure 1:
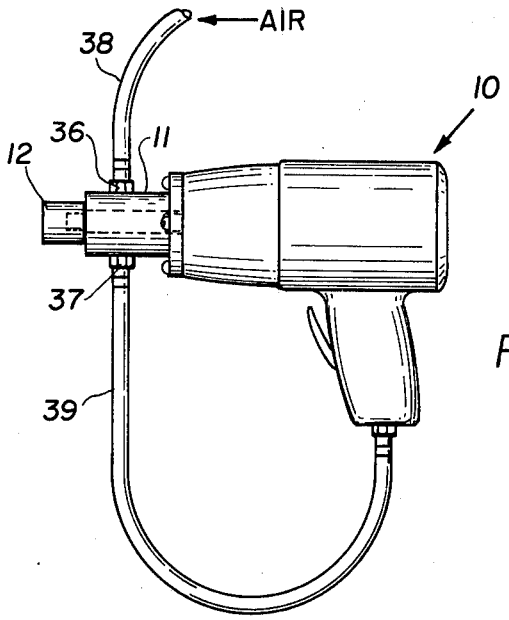
FIG. 1 is a side view showing an impact wrench with the torque contoller of the present invention mounted between the wrench and socket tool.
Figure 2:
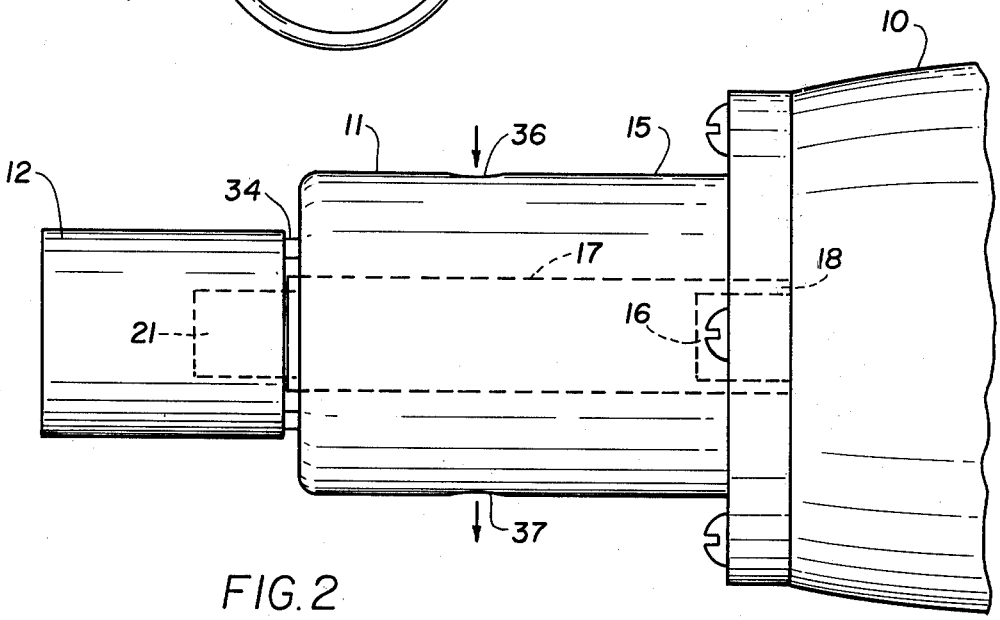
FIG. 2 is a side view showing the torque controller of the present invention mounted to the wrench and socket tool in greater detail.

Referring now to the drawings, there is shown in FIG. 1 a pneumatic impact wrench 10 incorporating the torque controller 11 of the present invention. The pneumatic impact wrench 10 is of conventional design and is powered by compressed air fed to a main drive motor contained in the housing. The torque controller 11 is mounted between the impact wrench 10 and the socket tool 12, which is of circular shape with any suitable diameter for turning and fastening a nut or bolt inserted therein. As can best be seen in FIG. 2, the torque controller of the present invention has a stationary cylindrical housing 15 with a square shaped opening 16 formed along its central portion. The housing 15 may be fixed to the wrench 10 as by bolts or other similar fastening means. The square shaped opening 16 is formed in a main shaft 17 rotatably mounted within the housing 15 for rotation relative thereto. The square shaped opening 16 extends from an end of the shaft 17 nearest to the impact wrench 10 to part way into the shaft as can best be seen in FIG. 5.

The shaft 17 is received in the housing 15 through an opening 18 formed in an end wall 19. The shaft 17 is rotatably mounted in the housing 15 in any conventional manner, such as by roller bearings mounted about the circumference of the shaft. A plurality of 0-rings 20 are provided about the end of the shaft 17 contained in the housing end wall 19 to prevent the escape of compressed air fed into a chamber 20 to be described in greater detail below. The square shaped opening 16 receives therein the drive end of the pneumatic impact wrench 10, the drive end (not shown) being of square shape with the length of the sides of the square being slightly less than the sides of the square shaped opening 16 for slidable engagement with the opening 16. The other end of the shaft 17 has a square shaped driving projection 21 which is received by an opening formed in the socket 12 to be described below. The central longitudinal axis of the shaft 17 is coextensive with the central longitudinal axes of the opening 16 and the driving projection 21.

Figure 5:
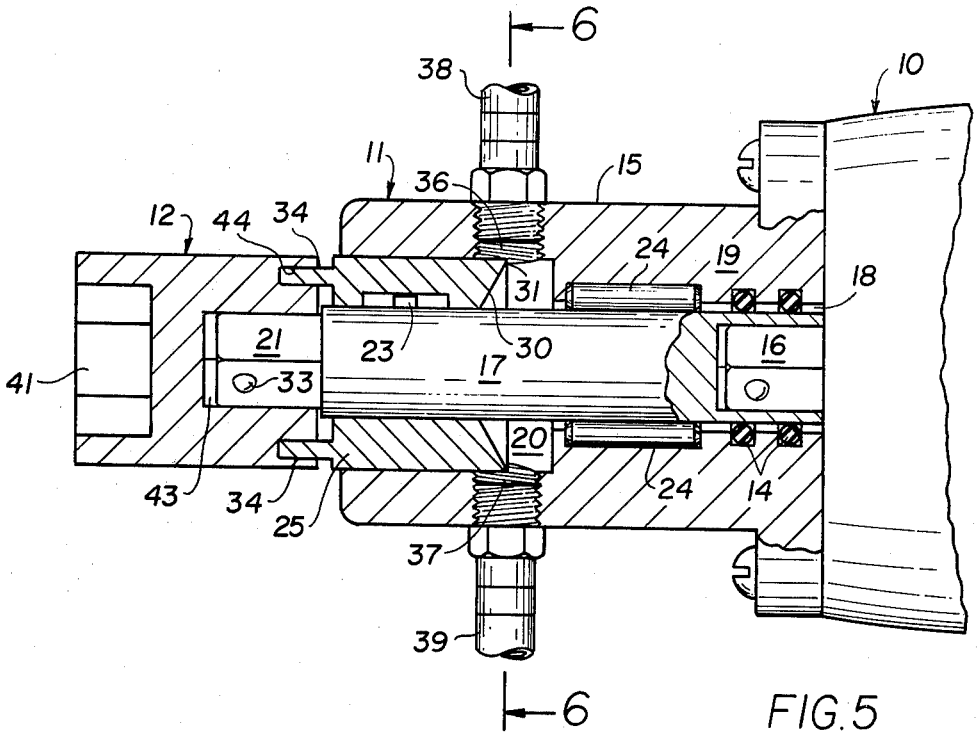
FIG. 5 is a side view in section of the torque controller of the present invention.
Figure 6:
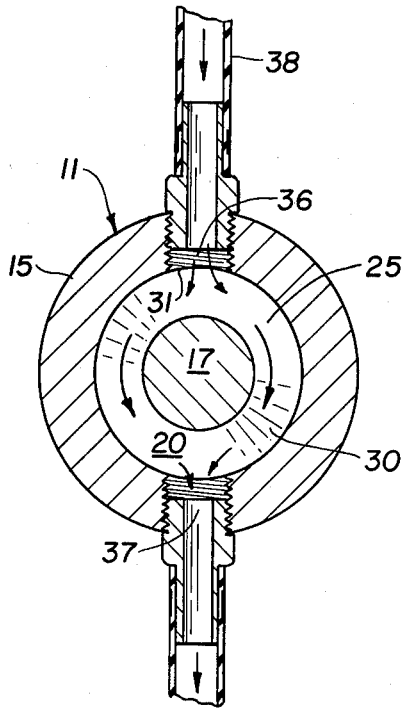
FIG. 6 is a sectional view taken along line 6—6 of FIG. 5.

Slidably mounted about the shaft 17 is a sliding member 25. The sliding member 25 is mounted for both sliding and rotatable movement on the shaft 17 by, for example, splines engaging in the grooves formed along the outer circumference of the shaft 17. It is to be noted that although the sliding member 25 is shown in FIG. 5 and 6 as being of one piece, it may be alternatively comprised of a series of slidable sections independently slidable along the shaft 17. The sliding member 25 has a circular base portion 26 with a circular opening formed along the center thereof for allowing passage of the shaft 17 therethrough and for allowing the rotatable and sliding engagement with the shaft.

The sliding member 25 is provided with a pair of fins 27, 28 extending radially from the circular base portion 26, fin 27 projecting from the base 26 at a diametrically opposite position to the fin 28. As can best be seen in FIG. 5, the fins 27, 28 have forward sloping front surfaces 30, 31. Projecting rearwardly of the circular base portion 26 on diametrically opposite locations with respect to the shaft 17 are two connecting members 34 which are of rectangular shape, but which may take on numerous other shapes. The members 34 engage in the circular groove of the socket tool to be described below.

The housing 15 is provided with an air intake opening 36 in which is connected an air intake hose 38, while on a diametrically opposite location to the intake opening 36, there is provided an air exhaust opening 37 to which is connected air exhaust hose 39. The air intake hose 38 is connected to a source of compressed air, while the air exhust hose 39 is connected at one end to the main drive motor of the impact wrench 10. As can best be seen in FIG. 5, the sliding member 25 forms along with the shaft 17 and end wall 19 an air passage chamber 20, the compressed air entering from the hose 38 rotating about the shaft 27 and exiting through the opening 37 to the motor of the impact wrench. The chamber 20 is a volume-adjustable due to the slidable movement of the sliding member 25. If, for example, a socket tool which drives a large nut or bolt is being used, greater torque needs to be supplied to the motor of the impact wrench, necessitating a greater volume capacity for the chamber 20. Thus, the sliding member 25 must be slid to the left in FIG. 5 to allow for the passage of a greater amount of compressed air to the motor.

In a similar fashion, when a socket tool which drives a nut or bolt of smaller diameter is being used, less torque is required of the motor of the impact wrench. Thus, the sliding member 25 need to be slid to the right in FIG. 5 thereby decreasing the volume of the chamber 20 and providing less compressed air to the motor.

Figure 3:
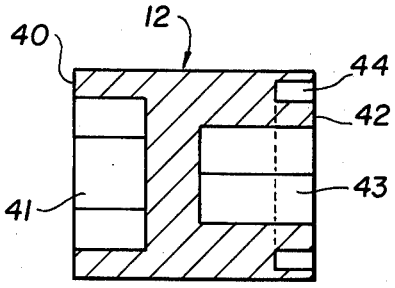
FIG. 3 is a side view in section showing the socket tool formed with circular groove of the present invention.
Figure 4:
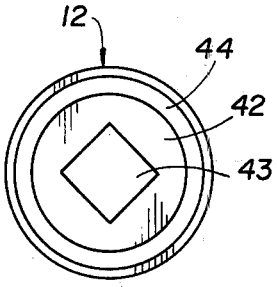
FIG. 4 is an end view of the socket tool of FIG. 3.

The above noted regulation of the compressed air to the motor of the impact wrench is achieved automatically in the present device. Referring to FIGS. 3 and 4, the socket tool used in the device of the present invention is shown and has a nut or bolt engaging end 40 with a circular opening 41 formed therein. A torque controller engaging end 42 is provided with a square opening 43 that is slightly larger in cross-section than the driving projection 21 so that the driving projection 21 fits snugly therein to drive the socket tool. A circular groove 44 is formed about the square opening 43 and has a depth as measured from the end 42 toward the end 40 directly proportional to the size of the nut or bolt being rotated. Thus, the socket tool rotating a nut or bolt of the maximum diameter allowable by the impact wrench being used will have a groove 44 of maximum depth, while a socket tool rotating a nut or bolt of smaller diameter will have a groove of lesser depth, the decrease in depth of the groove as compared to the maximum depth becoming greater as the size of the nut or bolt being rotated becomes smaller.

The members 34 and the circular groove 44 are spaced from the longitudinal axis of the shaft 17 such that when the socket tool is mounted on the driving projection 21, the members 34 will engage in the circular groove 44, the width of the circular groove being slightly greater than the width of the member 34 so as to snugly receive the members therein. The members 34 will be forced by the compressed air entering the chamber 20 towards the socket tool, the sliding movement of the sliding member 25 being limited by the depth of the circular groove 44.

The operation of the device will not be described. A socket tool and torque controller of the present invention are mounted on an impact wrench. The socket tool with a circular groove of a depth indicative of the size of the nut or bolt being rotated will initially position the sliding member 25 relative to the end wall 19 of the housing 15, thereby forming a chamber 20 of specific volume. Compressed air entering through inlet 36 will be supplied to the motor of the impact wrench in direct proportion to the volume of the chamber 20, thereby controlling the torque applied to the socket tool. When a second socket tool of different size replaces that previously mounted, the sliding member 25 will be automatically moved in accordance with the members 34 entering the groove 44 of the second socket tool, thereby repositioning the sliding member 25 to form a chamber 20 of different volume. For example, if the second socket tool drives a nut or bolt of larger diameter than the first socket took the depth of the groove 44 of the second socket tool, thereby positioning the sliding member closer to the socket tool and forming a chamber 20 of greater volume. Compressed air entering the inlet 36 will be supplied to the motor of the impact wrench in greater volume per unit time and thereby provide a greater torque to the second socket tool.

I claim:

1. A torque controller for use in pneumatic impact wrenches comprising a main housing having a first end wall and a second end wall, an inlet opening for compressed air, and an outlet opening for the exhaust of the compressed air; a shaft rotatably mounted between said first and second end walls having an opening formed in its end near said first end wall for receiving a driving member of an impact wrench, and a driving projection formed near said second end wall for driving engagement with a socket tool; and a sliding member mounted for slidable movement relative to said shaft, said sliding member comprising a base portion mounted around said shaft, said sliding member having groove engaging means mounted at its end near said second end wall for engagement with a groove in a socket tool, said sliding member being slidable to and away from said first end wall and forming therebetween a chamber, said chamber receiving compressed air from said inlet opening and exhausting compressed air by said outlet opening.

2. The torque controller according to claim 1, wherein said sliding member comprisies at least one fin projecting from said base portion, said at least one fin having a forward sloping surface sloping from said base portion toward said first end wall, said at least one fin regulating the amount of compressed air through said inlet opening and the amount of compressed exhaust through said outlet opening.

3. The torque controller according to claim 2, wherein said main hosuing is of cylindrical shape, and said inlet opening is positioned diametrically opposite to said outlet opening.

4. The torque controller according to claim 3, wherein said base portion is circular in cross-section and has two fins projecting therefrom, said shaft having a plurality of O-rings positioned thereabout near the end mounted at said first end wall.

5. A device for controlling the amount of compressed air supplied to a pneumatic impact wrench and the torque for rotating a nut or bolt comprising, in combination, a torque controller comprising a main housing having a first and a second end wall, an inlet opening formed in said main housing for compressed air, an outlet opening formed in said main housing for the exhaust of the compressed air, a shaft rotably mounted between said first and second end walls having an opening formed in its end near said first end wall for receiving a driving member of an impact wrench and a driving projection formed near said second end wall, and a sliding member mounted for slidable movement relative to said shaft comprising a base portion mounted around said shaft, said sliding member having a groove engaging means mounted at its end near said second end wall, and a chamber formed between said sliding member and said first end wall, said chamber receiving compressed air from said inlet opening and exhausting compressed air by said outlet opening; and a socket tool having a first end surface and a second end surface, said first end surface having an opening formed therein for receiving said driving projection therein, and a groove formed in said first end surface for receiving therein said groove engaging means.

6. The device according to claim 5, wherein said sliding member comprises at least one fin projecting from said base portion, said at least one fin having a forward sloping surface sloping from said base portion toward said first end wall, said at least one fin regulating the amount of compressed air through said inlet opening and the amount of compressed air through said outlet opening.

7. The device according to claim 5, wherein said groove is of circular shape, said opening in said socket tool having a longitudinal axis coextensive with the longitudinal axis of said shaft, and said circular groove having a center lying on said longitudinal axis of said opening.

8. A device for controlling the torque applied to a nut or bolt comprising in combination, a pneumatic impact wrench having a drive motor and a driving member driven by said drive motor, a torque controller comprising a main housing having a first and a second end wall, an inlet opening formed in said main housing for compressed air, an outlet opening formed in said main housing for the exhaust of the compressed air, a shaft rotatably mounted between said first and second end walls having an opening formed in its end near said first end wall for receiving said driving member of said impact wrench, and a driving projection near said second end wall, and a sliding member mounted for slidable movement relative to said shaft comprising a base portion mounted around said shaft, said sliding member having a groove engaging means mounted at its end near said second end wall, and a chamber formed between said sliding member and said first end wall, said chamber receiving compressed air from said inlet opening and exhausting the compressed air by said outlet opening, a socket tool having a first end surface and a second end surface, said first end surface having an opening formed therein for receiving said driving projection, and a groove formed in said first end surface for receiving therein said groove engaging means, and hose means connecting said inlet opening to a source of compressed air and connecting said outlet opening to said drive motor.

9. The device according to claim 8, wherein said sliding member comprises at least one fin projecting from said base portion, said at least one fin having a forward sloping surface sloping from said base portion toward said first end wall, said at least one fin regulating the amount of compressed air through said inlet opening and the amount of compressed air through said outlet opening.

10. The device according to claim 9, wherein said groove is of circular shape, said opening in said socket tool having a longitudinal axis coextensive with the longitudinal axis of said shaft, said circular groove having a center lying on said longitudinal axis of said opening.

* * * * *